US011568784B2

(12) United States Patent
Wang et al.

(10) Patent No.: US 11,568,784 B2
(45) Date of Patent: Jan. 31, 2023

(54) APPARATUSES AND METHODS FOR COMPENSATING FOR PIXEL DATA, DISPLAY PANELS AND STORAGE MEDIA

(71) Applicants: BOE MLED Technology Co., Ltd., Beijing (CN); BOE Technology Group Co., Ltd., Beijing (CN)

(72) Inventors: Mengmeng Wang, Beijing (CN); Zhitao Zhang, Beijing (CN); Xiurong Wang, Beijing (CN); Lingyun Shi, Beijing (CN); Tao Yang, Beijing (CN); Shicai Cao, Beijing (CN)

(73) Assignees: BOE MLED Technology Co, , Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/558,290

(22) Filed: Dec. 21, 2021

(65) Prior Publication Data

US 2022/0238057 A1 Jul. 28, 2022

(30) Foreign Application Priority Data

Jan. 26, 2021 (CN) ..... 202110106235.9

(51) Int. Cl.
*G09G 3/20* (2006.01)

(52) U.S. Cl.
CPC ..... *G09G 3/2003* (2013.01); *G09G 2320/029* (2013.01); *G09G 2320/0233* (2013.01); *G09G 2320/0242* (2013.01); *G09G 2320/0626* (2013.01); *G09G 2320/0666* (2013.01)

(58) Field of Classification Search
CPC ... G09G 2320/0233; G09G 2320/0242; G09G 2320/0271; G09G 2320/029; G09G 2320/0626; G09G 2320/0666; G09G 2360/16; G09G 3/2003
See application file for complete search history.

(56) References Cited

U.S. PATENT DOCUMENTS

| | | | | |
|---|---|---|---|---|
| 10,360,868 | B2 * | 7/2019 | Liu | G09G 3/3426 |
| 2016/0210103 | A1 * | 7/2016 | Yoshizumi | G06F 3/147 |
| 2017/0061901 | A1 * | 3/2017 | Zhang | G09G 3/3426 |
| 2018/0040271 | A1 * | 2/2018 | Jung | G09G 3/20 |
| 2020/0279534 | A1 * | 9/2020 | Ji | G09G 3/3648 |

FOREIGN PATENT DOCUMENTS

| | | | |
|---|---|---|---|
| CN | 109658900 | A | 4/2019 |

* cited by examiner

*Primary Examiner* — Kenneth Bukowski
(74) *Attorney, Agent, or Firm* — IPro, PLLC

(57) ABSTRACT

The present disclosure relates to an apparatus and method for compensating for pixel data, a display panel and a storage medium. In one or more embodiments, the method includes: obtaining a first display area and a second display area of the display panel; obtaining, by mapping respective initial pixel data of pixels in the first display area using a preset grayscale target value, respective intermediate pixel data of the pixels in the first display area; and obtaining, by compensating for respective initial pixel data of pixels in the second display area and the respective intermediate pixel data of the pixels in the first display area using preset compensation coefficients, respective target pixel data of pixels in the second display area and the first display area.

20 Claims, 4 Drawing Sheets

APPARATUSES AND METHODS FOR COMPENSATING FOR PIXEL DATA, DISPLAY PANELS AND STORAGE MEDIA

CROSS REFERENCE TO RELATED APPLICATIONS

This application claims priority to Chinese Patent Application No. 202110106235.9 entitled "APPARATUSES AND METHODS FOR COMPENSATING FOR PIXEL DATA, DISPLAY PANELS AND STORAGE MEDIA" filed on Jan. 26, 2021, the entire content of which is incorporated herein by reference.

TECHNICAL FIELD

The present disclosure relates to the field of display technology, and in particular to, apparatuses and methods for compensating for pixel data, display panels and storage media.

BACKGROUND

As users have higher and higher demands for display quality, display function, and power consumption of a display device, a display in which images are displayed with a high resolution at a high refresh rate in an area to which fixation points of an eye corresponds appears in the market, which is hereinafter referred to as a smartview display. Since the smartview display only displays images with high resolution at a high refresh rate in a fixation area, and displays images with low resolution at a low refresh rate in a non-fixation area, power consumption can be reduced.

SUMMARY

According to a first aspect of the embodiments of the present disclosure, there is provided an apparatus for compensating for pixel data applied to a display panel, including: a display area obtaining module configured to obtain a first display area and a second display area of the display panel; an intermediate data obtaining module configured to obtain, by mapping respective initial pixel data of pixels in the first display area using a preset grayscale target value, respective intermediate pixel data of the pixels in the first display area; and a target data obtaining module configured to obtain, by compensating for respective initial pixel data of pixels in the second display area and the respective intermediate pixel data of the pixels in the first display area using preset compensation coefficients, respective target pixel data of pixels in the second display area and the first display area.

Optionally, the intermediate data obtaining module includes: a level obtaining unit configured to obtain a grayscale level of pixels in the display panel; a ratio obtaining unit configured to obtain a ratio of the preset grayscale target value to the grayscale level; and a first product obtaining unit configured to for each of the pixels in the first display area, obtain a product of the ratio and initial pixel data of the pixel and take the product as intermediate pixel data of the pixel.

Optionally, the target data obtaining module includes: a second product obtaining unit configured to, for each of the pixels in the second display area, obtain a product of a first coefficient in the compensation coefficients corresponding to the pixel and initial pixel data of the pixel; and for each of the pixels in the first display area, obtain a product of the first coefficient in the compensation coefficients corresponding to the pixel and intermediate pixel data of the pixel; and a sum obtaining unit configured to for each of the pixels in the second display area and the first display area, obtain a sum of the product corresponding to the pixel and a second coefficient in the compensation coefficients corresponding to the pixel and take the sum as target pixel data of the pixel.

Optionally, the apparatus further includes a target value obtaining module configured to obtain the preset grayscale target value; the target value obtaining module includes: a first brightness obtaining unit, configured to obtain brightness of the first display area and brightness of the second display area in the display panel respectively; wherein the second display area refers to an eye fixation area determined according to fixation points of an eye on the display panel, and the first display area refers to an area in the display panel other than the second display area; and a data obtaining unit configured to obtain, by adjusting the brightness of the first display area until a ratio of the brightness of the second display area to the brightness of the first display area satisfies a preset ratio threshold, a maximum grayscale of the pixels in the first display area; wherein the maximum grayscale of the pixels in the first display area is the preset grayscale target value.

Optionally, the apparatus further includes a compensation coefficient obtaining module configured to obtain the preset compensation coefficients; the compensation coefficient obtaining module includes: a second brightness obtaining unit configured to for each of a specified number of preset pixel grayscales, obtain respective brightness data of pixels in the display panel when displaying the preset pixel grayscale; a target value obtaining unit, configured to obtain an average value of brightness data of the pixels according to the respective brightness data of the pixels when displaying the preset pixel grayscale and take the average value as a compensation target value corresponding to the preset pixel grayscale; a grayscale compensating unit configured to obtain, according to a preset correspondence between grayscales and brightness, respective compensation grayscales of the pixels at the preset pixel grayscale based on the compensation target value; and a grayscale fitting unit configured to for each of the pixels, obtain a fitting curve by fitting the specified number of preset pixel grayscales and corresponding compensation grayscales; wherein first coefficients and second coefficients of the fitting curves constitute the compensation coefficients.

According to a second aspect of the embodiments of the present disclosure, there is provided a method of compensating for pixel data applied to a display panel, including: obtaining a first display area and a second display area of the display panel; obtaining, by mapping respective initial pixel data of pixels in the first display area using a preset grayscale target value, respective intermediate pixel data of the pixels in the first display area; and obtaining, by compensating for respective initial pixel data of pixels in the second display area and the respective intermediate pixel data of the pixels in the first display area using preset compensation coefficients, respective target pixel data of pixels in the second display area and the first display area.

Optionally, obtaining, by mapping the respective initial pixel data of the pixels in the first display area using the preset grayscale target value, the respective intermediate pixel data of the pixels in the first display area, includes: obtaining a grayscale level of pixels in the display panel; obtaining a ratio of the preset grayscale target value to the grayscale level; and for each of the pixels in the first display area, obtaining a product of the ratio and initial pixel data of the pixel and taking the product as intermediate pixel data of the pixel.

Optionally, obtaining, by compensating for the respective initial pixel data of the pixels in the second display area and the respective intermediate pixel data of the pixels in the first display area using the preset compensation coefficients, the respective target pixel data of the pixels in the second display area and the first display area, includes: for each of the pixels in the second display area, obtaining a product of a first coefficient in the compensation coefficients corresponding to the pixel and initial pixel data of the pixel, for each of the pixels in the first display area, obtaining a product of the first coefficient in the compensation coefficients corresponding to the pixel and intermediate pixel data of the pixel; and for each of the pixels in the second display area and the first display area, obtaining a sum of the product corresponding to the pixel and a second coefficient in the compensation coefficients corresponding to the pixel and taking the sum as target pixel data of the pixel.

Optionally, the method further includes obtaining the preset grayscale target value, including: obtaining brightness of the first display area and brightness of the second display area in the display panel respectively; wherein the second display area refers to an eye fixation area determined according to fixation points of an eye on the display panel, and the first display area refers to an area in the display panel other than the second display area; and obtaining, by adjusting the brightness of the first display area until a ratio of the brightness of the second display area to the brightness of the first display area satisfies a preset ratio threshold, a maximum grayscale of the pixels in the first display area; wherein the maximum grayscale of the pixels in the first display area is the preset grayscale target value.

Optionally, the method further includes obtaining the preset compensation coefficients, including: for each of a specified number of preset pixel grayscales, obtaining respective brightness data of pixels in the display panel when displaying the preset pixel grayscale; obtaining an average value of brightness data of the pixels according to the respective brightness data of the pixels when displaying the preset pixel grayscale and taking the average value as a compensation target value corresponding to the preset pixel grayscale; obtaining, according to a preset correspondence between grayscales and brightness, respective compensation grayscales of the pixels at the preset pixel grayscale based on the compensation target value; and for each of the pixels, obtaining a fitting curve by fitting the specified number of preset pixel grayscales and corresponding compensation grayscales; wherein first coefficients and second coefficients of the fitting curves constitute the compensation coefficients.

Optionally, a value range of the ratio threshold is 97% to 99%.

Optionally, obtaining the brightness of the first display area and the brightness of the second display area includes: for each of the first display area and the second display area, obtaining an average value of brightness of all pixels, or obtaining an average value of brightness of several pixels, or obtaining brightness of any pixel.

According to a third aspect of the embodiments of the present disclosure, there is provided a display panel, including: a processor; a memory storing a computer program executable by the processor; wherein the processor is configured to execute the computer program in the memory to implement the above-mentioned methods.

According to a fourth aspect of the embodiments of the present disclosure, there is provided a non-transitory computer-readable storage medium, wherein an executable computer program in the storage medium is executed by a processor to implement the above-mentioned methods.

It should be understood that the above general descriptions and subsequent detailed descriptions are merely illustrative and explanatory and shall not be intended to limit the present disclosure.

BRIEF DESCRIPTION OF DRAWINGS

The accompanying drawings herein are incorporated in and constitute a part of this specification, illustrate embodiments consistent with the present disclosure, and together with the description serve to explain the principles of the disclosure.

DETAILED DESCRIPTION

Figure 1:
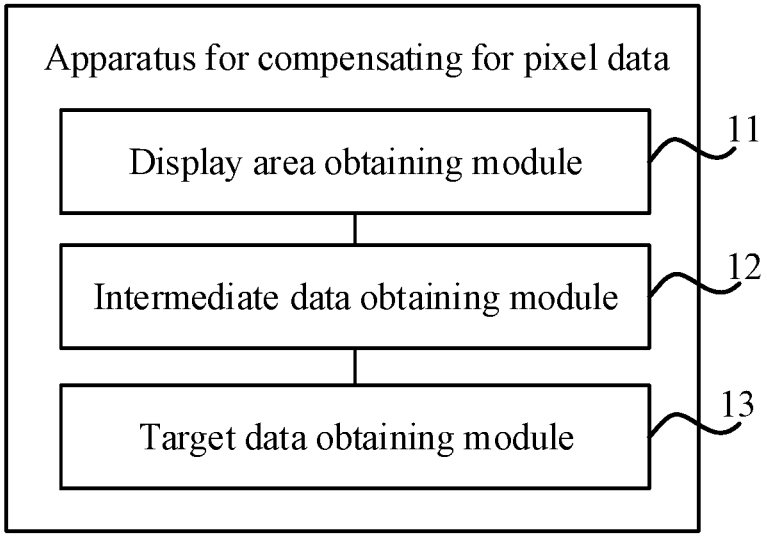
FIG. 1 is a block diagram of an apparatus for compensating for pixel data according to an exemplary embodiment.

Examples will be described in detail herein, with the illustrations thereof represented in the drawings. When the following descriptions involve the drawings, same numbers in different drawings refer to same or similar elements unless otherwise indicated. The embodiments described in the following examples do not represent all embodiments consistent with the present disclosure. Rather, they are merely examples of apparatuses and methods consistent with some aspects of the present disclosure as detailed in the appended claims.

Due to the limitation of a process and technology of a driver chip, brightness of a fixation area in the smartview display may be somewhat dim due to insufficient charging time, and a brightness difference between the fixation area and a non-fixation area may affect a visual effect.

One or more embodiments of the present disclosure provide an apparatus for compensating for pixel data. FIG. 1 is a block diagram of an apparatus for compensating for pixel data according to an exemplary embodiment. Referring to FIG. 1, an apparatus for compensating for pixel data, which can be applied to a display panel, includes: a display area obtaining module 11, configured to obtain a first display area and a second display area of the display panel; an intermediate data obtaining module 12, configured to obtain respective intermediate pixel data of pixels/pixel points in the first display area by mapping respective initial pixel data of the pixels in the first display area using a preset grayscale target value; and a target data obtaining module 13, configured to obtain respective target pixel data of pixels in the second display area and the first display area by compensating for respective initial pixel data of pixels in the second display area and the respective intermediate pixel data of the pixels in the first display area using preset compensation coefficients.

In this way, in this embodiment, by setting a preset grayscale target value, respective pixel data of pixels in the first display area can be mapped, such that a maximum grayscale of the pixels in the first display area does not exceed the preset grayscale target value, thereby achieving an effect that brightness of the first display area is consistent with that of the second display area, and improving vision uniformity of the display panel. Moreover, in this embodiment, a set of compensation coefficients can be used to compensate for pixel data of the first display area and the second display area. There is no need to set respective set of compensation coefficients for the two display areas respectively, which can reduce the storage space occupied by the compensation coefficients.

In this embodiment, the display area obtaining module 11 can obtain the first display area and the second display area of the display panel. In an embodiment, an eye tracking module can be provided on the display panel, and the eye tracking module can track movement of an eye using eye-tracking technology to determine fixation points of the eye on the display panel, and thus determine an eye fixation area. The eye tracking module can store the eye fixation area in a designated position after obtaining the eye fixation area. In this case, the display area obtaining module 11 can obtain the eye fixation area from the designated position, and determine the first display area and the second display area of the display panel according to the eye fixation area. The second display area refers to the eye fixation area, that is, the eye fixation area determined according to the fixation points of the eye on the display panel. The first display area refers to an area in the display panel other than the second display area. In an embodiment, the display area obtaining module 11 can further communicate with the eye tracking module to directly receive the eye fixation area sent by the eye tracking module, and determine the first display area and the second display area of the display panel according to the eye fixation area. In an embodiment, the display area obtaining module 11 can be implemented by the eye tracking module, which can track the movement of the eye, determine the fixation points of the eye on the display panel, and thus the eye fixation area, and finally determine the first display area and the second display area of the display panel.

Figure 2:
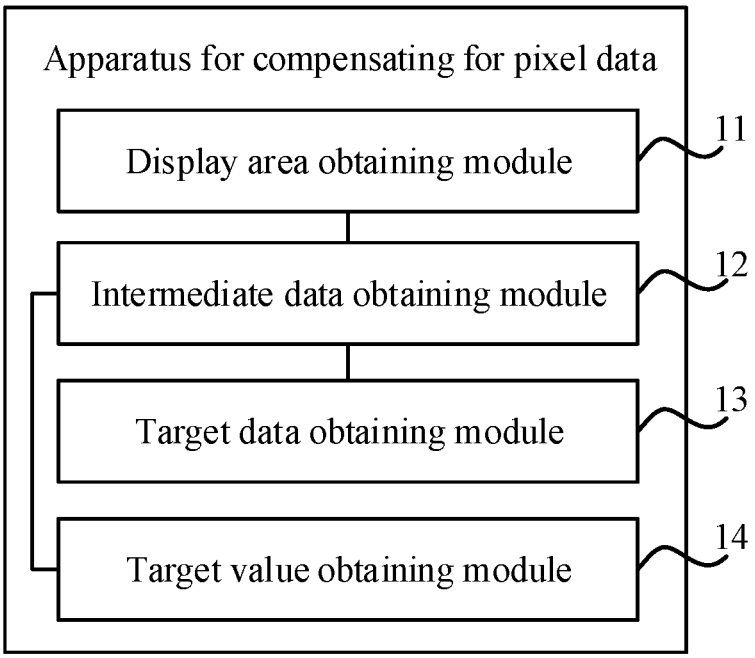
FIG. 2 is a block diagram of another apparatus for compensating for pixel data according to an exemplary embodiment.
Figure 3:
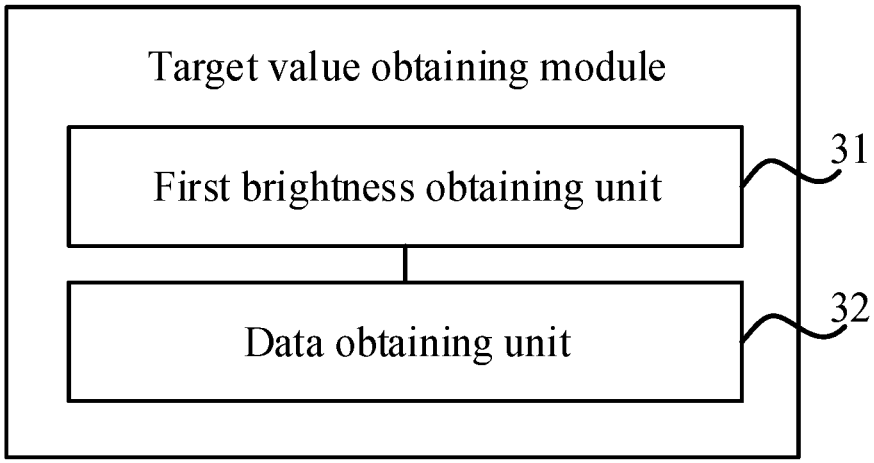
FIG. 3 is a block diagram of a target value obtaining module according to an exemplary embodiment.

In this embodiment, referring to FIG. 2, the apparatus for compensating for pixel data may further include a target value obtaining module 14, configured to obtain the preset grayscale target value. Referring to FIG. 3, the target value obtaining module 14 may include a first brightness obtaining unit 31 and a data obtaining unit 32.

The first brightness obtaining unit 31 is configured to obtain brightness of the first display area and brightness of the second display area in the display panel respectively. For example, during a display process of the display panel, the user's sight is kept immobile, that is, the eye fixation area (or the second display area) is fixed, and the first brightness obtaining unit 31 can obtain the brightness of the second display area and the brightness of the first display area respectively.

It is to be understood that the refresh rate and resolution of the second display area are higher than those of the first display area, which may result in a phenomenon that the brightness of the pixels in the second display area is somewhat dim due to insufficient charging time. Therefore, in an example, the first brightness obtaining unit 31 can make the grayscale of all pixels be a maximum grayscale of the pixel, such that a more accurate grayscale target value can be obtained.

The data obtaining unit 32 is configured to obtain a maximum grayscale of the pixels in the first display area by adjusting the brightness of the first display area until a ratio of the brightness of the second display area to the brightness of the first display area satisfies a preset ratio threshold. The maximum grayscale of the pixels in the first display area is the preset grayscale target value. For example, the data obtaining unit 32 can adjust the grayscale of each pixel in the first display area to achieve an effect of adjusting the brightness of the first display area until the ratio of the brightness of the second display area to the brightness of the first display area satisfies the preset ratio threshold. The ratio threshold can be adjusted. In an example, a value range of the ratio threshold is 97% to 99%. When the ratio satisfies the ratio threshold, it indicates that the brightness uniformity of the display panel satisfies the requirement. In this case, the maximum grayscale of the pixels in the first display area can be obtained, and the maximum grayscale is the preset grayscale target value $GL_{non\text{-}fixation}$.

It should be noted that obtaining the brightness of the first display area and the brightness of the second display area includes: for each of the first display area and the second display area, obtaining an average value of brightness of all pixels, or obtaining an average value of brightness of several pixels, or obtaining brightness of any pixel. On condition that the preset grayscale target value can be determined, each solution falls within the protection scope of the present disclosure.

Figure 4:
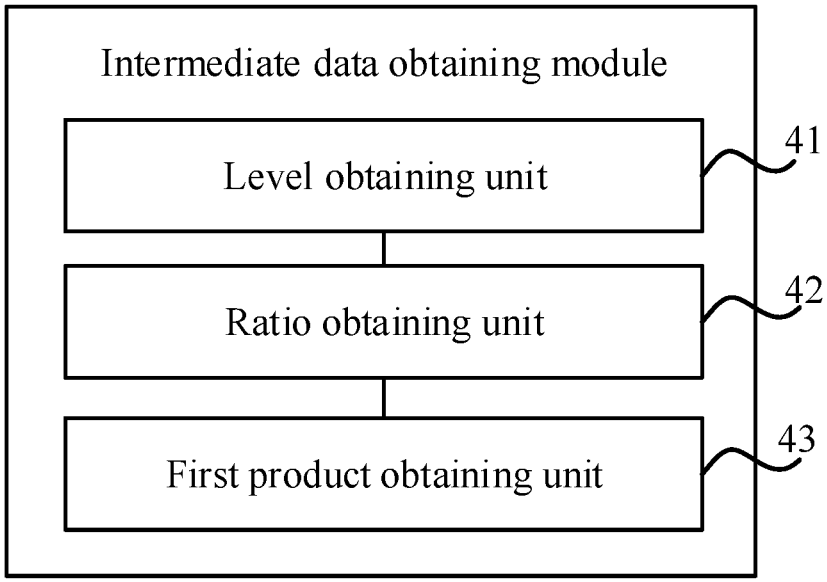
FIG. 4 is a block diagram of an intermediate data obtaining module according to an exemplary embodiment.

In this embodiment, the intermediate data obtaining module 12 can obtain respective initial pixel data of pixels in the first display area during a display process, and map the respective initial pixel data to obtain respective intermediate pixel data of the pixels in the first display area. Referring to FIG. 4, the intermediate data obtaining module 12 may include a level obtaining unit 41, a ratio obtaining unit 42 and a first product obtaining unit 43.

The level obtaining unit 41 is configured to obtain a grayscale level of pixels in the display panel. For example, the level obtaining unit 41 can obtain the grayscale level of the pixels in the display panel as 2^N, for example, the grayscale level of an 8-bit display panel (N=8) is 2^8=256. The ratio obtaining unit 42 is configured to obtain a ratio of the preset grayscale target value to the grayscale level. For example, the ratio obtaining unit 42 can obtain the ratio of the preset grayscale target value to the grayscale level as $GL_{non\text{-}fixation}/2^N$. The first product obtaining unit 43 is configured to, for each of the pixels in the first display area, obtain a product of the ratio and initial pixel data of the pixel and take the product as intermediate pixel data of the pixel. For example, for each of the pixels in the first display area, the first product obtaining unit 43 can obtain the product of the ratio and initial pixel data of the pixel and take the product as intermediate pixel data of the pixel, that is $GL*GL_{non\text{-}fixation}/2^N$.

It should be noted that in the embodiment shown in FIG. 4, pixel data of the pixels in the first display area is mapped from a larger grayscale range to a smaller grayscale range, and the number of grayscale levels remains unchanged. Therefore, the macroscopic brightness of the first display area can be consistent with that of the second display area.

It should be noted that in the mapping process, only multiplication and division operations are involved, and only shift operations are needed for the intermediate data obtaining module 12, which is simple and fast, and can minimize the compensation delay.

In this embodiment, the target data obtaining module 13 can compensate for respective initial pixel data of pixels in the second display area and respective intermediate pixel data of pixels in the first display area using preset compensation coefficients, so as to obtain respective target pixel data of pixels in the second display area and the first display area.

Figure 5:
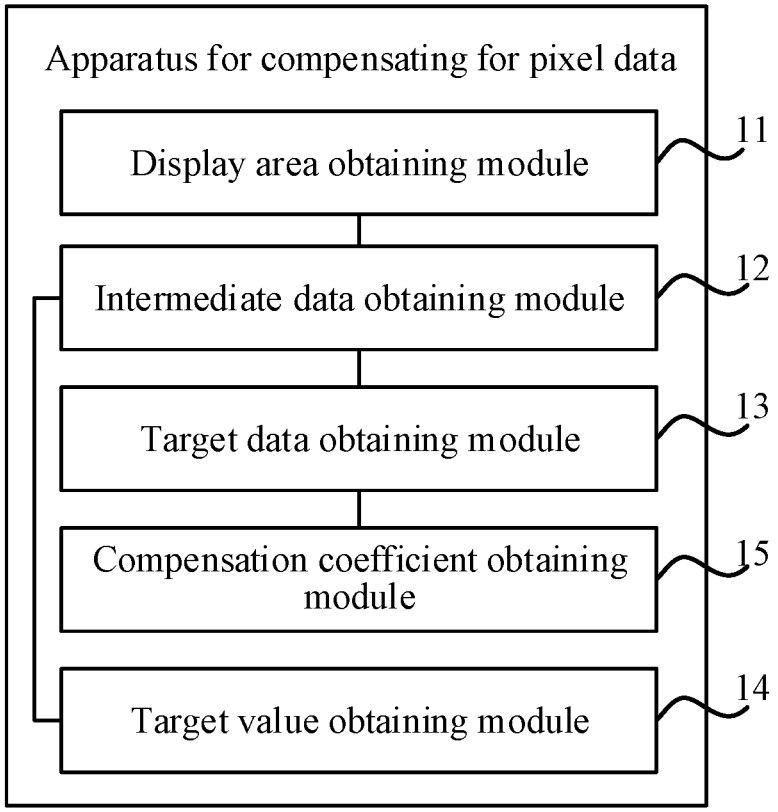
FIG. 5 is a block diagram of another apparatus for compensating for pixel data according to an exemplary embodiment.
Figure 6:
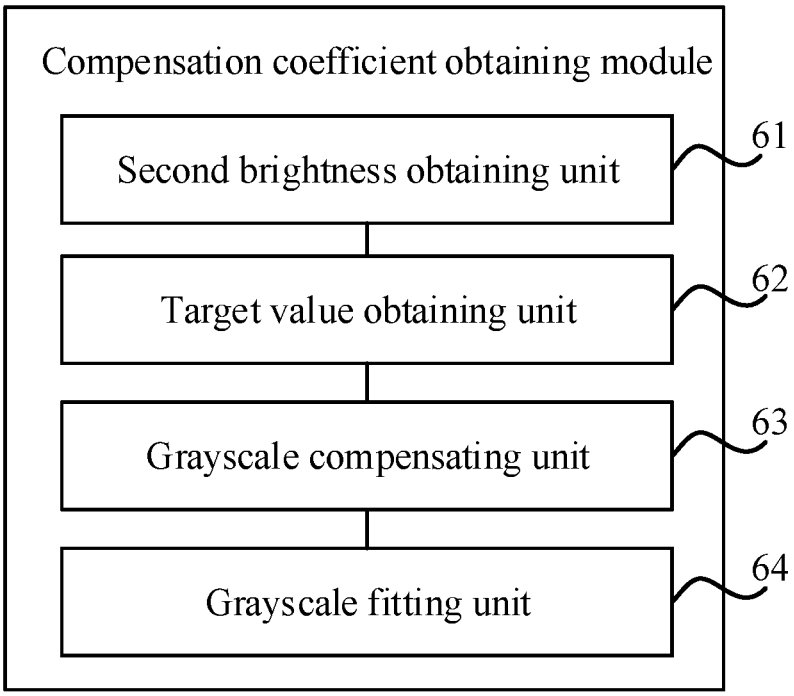
FIG. 6 is a block diagram of a compensation coefficient obtaining module according to an exemplary embodiment.

In this embodiment, referring to FIG. 5, the apparatus for compensating for pixel data may further include a compensation coefficient obtaining module 15, configured to obtain the preset compensation coefficients. Referring to FIG. 6, the compensation coefficient obtaining module 15 may include a second brightness obtaining unit 61, a target value obtaining unit 62, a grayscale compensating unit 63 and a grayscale fitting unit 64.

The second brightness obtaining unit 61 is configured to for each of a specified number of preset pixel grayscales, obtain respective brightness data of pixels in the display panel when displaying the preset pixel grayscale. For example, the specified number can be six. Taking an 8-bit display panel as an example, the preset pixel grayscales can be six grayscales of GL32, GL64, GL96, GL128, GL224, and GL255. Taking the GL32 grayscale as an example, if the pixel data of all pixels in the display panel are the GL32 grayscale, the second brightness obtaining unit 61 can measure brightness data $L_i^{GL32}$ of each pixel.

The target value obtaining unit 62 is configured to obtain an average value of brightness data of the pixels according to the respective brightness data of the pixels when displaying the preset pixel grayscale and determine the average value as a compensation target value corresponding to the preset pixel grayscale. For example, for the GL grayscale, the average value of the brightness data of all pixel points is $L_{average}^{GL}=\sum_{i=1}^{N} L_i^{GL}/N$.

The grayscale compensating unit 63 is configured to obtain respective compensation grayscales of the pixels at the preset pixel grayscale based on the compensation target value according to a preset correspondence between grayscales and brightness. For example, the grayscale compensating unit 63 can calculate a compensation grayscale $C_i^{GL}$ of each pixel after each pixel at the grayscale GL is compensated for. For example, the compensation grayscale=a current grayscale of the pixel*(brightness data of the pixel/compensation target value of the pixel) ^ (1/Gamma), that is, the compensation grayscale can be obtained through a de-Gamma processing.

The grayscale fitting unit 64 is configured to for each of the pixels, obtain a fitting curve by fitting the specified number of preset pixel grayscales and corresponding compensation grayscales; where, first coefficient and second coefficient of the fitting curve constitute the compensation coefficients. For example, the grayscale fitting unit 64 can perform linear fitting according to the grayscales GL32, GL64, GL96, GL128, GL224, GL255 and the corresponding compensation grayscales $C_i^{GL}$, and calculate compensation coefficients (a, b). For compensation coefficients (a, b), a represents the first coefficient, and b represents the second coefficient. Then, the compensation coefficients (a, b) can be stored in a designated position to facilitate the target data obtaining module 13 to read in real time. In an embodiment, the first coefficient is a slope of the fitted curve, and the second coefficient is an intercept of the fitted curve on the y-axis.

In an embodiment, the compensation coefficient obtaining module 15 obtains the compensation coefficients (a, b) for all pixels in the second display area without involving the pixels in the first display area.

Figure 7:
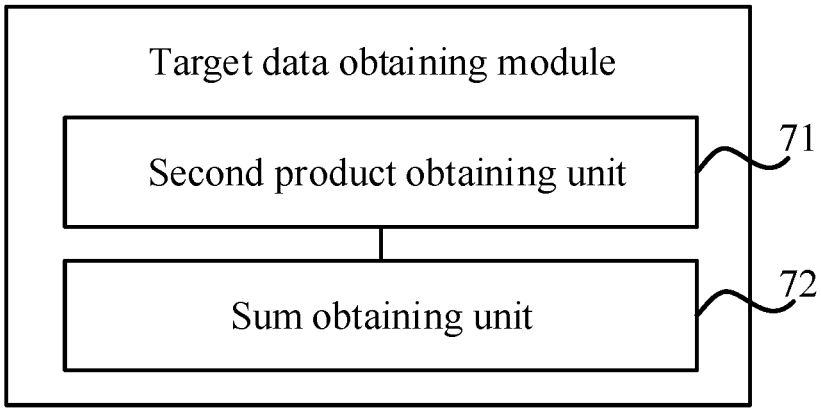
FIG. 7 is a block diagram of a target data obtaining module according to an exemplary embodiment.

In this embodiment, referring to FIG. 7, the target data obtaining module 13 may include a second product obtaining unit 71 and a sum obtaining unit 72.

The second product obtaining unit 71 is configured to for each of the pixels in the second display area, obtain a product of a first coefficient in compensation coefficients corresponding to the pixel and initial pixel data of the pixel; and for each of the pixels in the first display area, obtain a product of the first coefficient in the compensation coefficients corresponding to the pixel and intermediate pixel data of the pixel. The second product obtaining unit 71 can divide the process of obtaining the product into two processing steps, that is, the second product obtaining unit 71 compensates for respective initial pixel data of the pixels in the second display area, and the second product obtaining unit 71 compensates for respective intermediate pixel data of the pixels in the first display area, and the order of the two processing steps is not limited.

The sum obtaining unit 72 is configured to for each of the pixels in the second display area and the first display area, obtain a sum of the product corresponding to the pixel and a second coefficient in the compensation coefficients corresponding to the pixel and take the sum as target pixel data of the pixel. For example, the target pixel data of each of the pixels in the second display area is a*P+b, where P is the initial pixel data of the pixel, and a and b are the first coefficient and the second coefficient in the compensation coefficients, respectively. For another example, the target pixel data of each of the pixels in the first display area is $C_i^{non\text{-}fixation/GL}=GL*GL_{non\text{-}fixation}/2\hat{}N*a+b$. $GL*GL_{non\text{-}fixation}/2\hat{}N$ is the intermediate pixel data of the pixel.

It should be noted that from a macroscopic point of view, the intermediate data obtaining module 12 can keep the brightness of both the first display area and the second display area consistent, but from a microscopic point of view, the mura at the pixel level still exists. Therefore, the target data obtaining module 13 compensates for the intermediate pixel data using the compensation coefficients, thereby relieving the mura at the pixel level and further enhancing the vision uniformity.

In this embodiment, the target data obtaining module 13 can send the target pixel data of each pixel to a drive apparatus of the display panel after obtaining the target pixel data of each pixel. The drive apparatus controls each pixel of the display panel to display according to the target pixel data of each pixel, thereby achieving an effect that the brightness of the first display area is consistent with that of the second display area.

It should be noted that the intermediate data obtaining module 12 and the target data obtaining module 13 adopt a solution of first mapping and then compensating for the initial pixel data of the first display area. In an embodiment, the mapping and compensation can be implemented in a same module. For example, the target data obtaining module 13 can directly obtain the target pixel data of each pixel in the first display area based on $C_i^{non\text{-}fixation/GL}=GL*GL_{non\text{-}fixation}/2\hat{}N*a+b$, and the corresponding solution also falls within the protection scope of the present disclosure.

The embodiments of the present disclosure provide an apparatus for compensating for pixel data, which can be applied to a display panel. The apparatus can include a display area obtaining module, an intermediate data obtaining module and a target data obtaining module. The display area obtaining module is configured to obtain a first display area and a second display area of the display panel. The intermediate data obtaining module is configured to obtain respective intermediate pixel data of pixels in the first display area by mapping respective initial pixel data of the pixels in the first display area using a preset grayscale target value. The target data obtaining module is configured to obtain respective target pixel data of pixels in second display area and the first display area by compensating for respective initial pixel data of the pixels in the second display area and the respective intermediate pixel data of the pixels in the first display area using preset compensation coefficients. In this embodiment, by setting the preset grayscale target value, the respective pixel data of the pixels in the first display area can be mapped, such that a maximum grayscale of the pixels in the first display area does not exceed the preset grayscale target value, thereby achieving an effect that brightness of the first display area is consistent with that of the second display area, and improving vision uniformity of the display panel. Moreover, in this embodiment, a set of compensation coefficients can be used to compensate for pixel data of the first display area and the second display area, and only one grayscale target value needs to be added (for an 8-bit display panel, only 1 byte of storage space is needed). There is no need to set respective set of compensation coefficients for the two display areas respectively, which can reduce the storage space occupied by the compensation coefficients.

Figure 8:
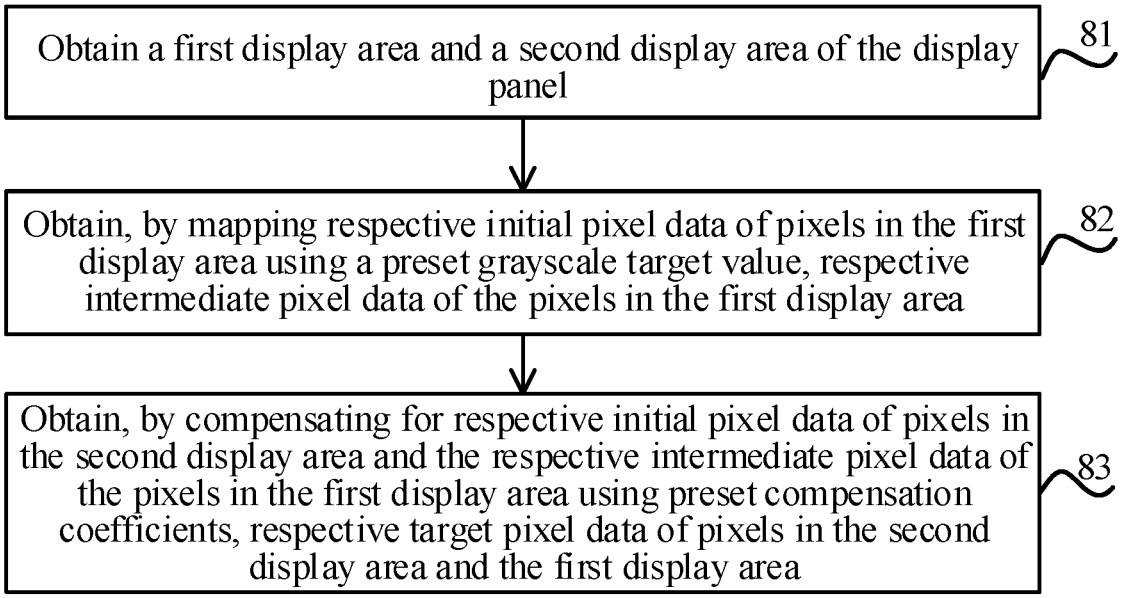
FIG. 8 is a flowchart of a method of compensating for pixel data according to an exemplary embodiment.

On the basis of an apparatus for compensating for pixel data provided by one or more embodiments of the present disclosure, the one or more embodiments of the present disclosure further provide a method of compensating for pixel data, which is applied to a display panel. FIG. 8 is a flowchart of a method of compensating for pixel data according to an exemplary embodiment. Referring to FIG. 8, a method of compensating for pixel data includes: in step 81, obtaining a first display area and a second display area of the display panel; in step 82, obtaining, by mapping respective initial pixel data of pixels in the first display area using a preset grayscale target value, respective intermediate pixel data of the pixels in the first display area; and in step 83, obtaining, by compensating for respective initial pixel data of pixels in the second display area and the respective intermediate pixel data of the pixels in the first display area using preset compensation coefficients, respective target pixel data of pixels in the second display area and the first display area.

In an embodiment, obtaining, by mapping the respective initial pixel data of the pixels in the first display area using the preset grayscale target value, the respective intermediate pixel data of the pixels in the first display area, includes: obtaining a grayscale level of pixels in the display panel; obtaining a ratio of the preset grayscale target value to the grayscale level; and for each of the pixels in the first display area, obtaining a product of the ratio and initial pixel data of the pixel and taking the product as intermediate pixel data of the pixel.

In an embodiment, obtaining, by compensating for the respective initial pixel data of the pixels in the second display area and the respective intermediate pixel data of the pixels in the first display area using the preset compensation coefficients, the respective target pixel data of the pixels in the second display area and the first display area, includes: for each of the pixels in the second display area, obtaining a product of a first coefficient in the compensation coefficients corresponding to the pixel and initial pixel data of the pixel, for each of the pixels in the first display area, obtaining a product of the first coefficient in the compensation coefficients corresponding to the pixel and intermediate pixel data of the pixel; and for each of the pixels in the second display area and the first display area, obtaining a sum of the product corresponding to the pixel and a second coefficient in the compensation coefficient corresponding to the pixel and taking the sum as target pixel data of the pixel.

In an embodiment, the method further includes obtaining the preset grayscale target value, which can include: obtaining brightness of the first display area and brightness of the second display area in the display panel respectively; where the second display area refers to an eye fixation area determined according to fixation points of an eye on the display panel, and the first display area refers to an area in the display panel other than the second display area; and obtaining, by adjusting the brightness of the first display area until a ratio of the brightness of the second display area to the brightness of the first display area satisfies a preset ratio threshold, a maximum grayscale of the pixels in the first display area; where the maximum grayscale of the pixels in the first display area is the preset grayscale target value.

In an embodiment, the method further includes obtaining the preset compensation coefficients, which can include: for each of a specified number of preset pixel grayscales, obtaining respective brightness data of pixels in the display panel when displaying the preset pixel grayscale; obtaining an average value of brightness data of the pixels according to the respective brightness data of the pixels when displaying the preset pixel grayscale and taking the average value as a compensation target value corresponding to the preset pixel grayscale; obtaining, according to a preset correspondence between grayscales and brightness, respective compensation grayscales of the pixels at the preset pixel grayscale based on the compensation target value; and for each of the pixels, obtaining a fitting curve by fitting the specified number of preset pixel grayscales and corresponding compensation grayscales; where first coefficients and second coefficients of the fitting curves constitute the compensation coefficients.

It is understandable that the methods provided by the embodiments of the present disclosure correspond to the above-mentioned apparatuses, and the specific content can refer to the content of various embodiments of the methods, which will not be repeated here.

In an exemplary embodiment, there is further provided a display panel, including: a processor; a memory storing a computer program executable by the processor; where the processor is configured to execute the computer program in the memory to implement the steps of the above-mentioned methods.

In an exemplary embodiment, there is further provided a non-transitory computer-readable storage medium, such as a memory including instructions, where an executable computer program in the storage medium is executed by a processor to implement the steps of the above-mentioned methods. The computer-readable storage medium may be ROM, random access memory (RAM), CD-ROM, magnetic tape, floppy disk, optical data storage device, etc.

Other implementations of the present disclosure will be apparent to those skilled in the art from consideration of the specification and practice of the present disclosure herein. The present disclosure is intended to cover any variations, uses or adaptive modification that follow the general principles of the present disclosure and include common knowledge or conventional technical means in the related art that are not disclosed in the present disclosure. The specification and embodiments are considered as exemplary only, with a true scope and spirit of the present disclosure being indicated by the following claims.

It is to be understood that the present disclosure is not limited to the precise structure described above and shown in the accompanying drawings, and that various modifications and changes may be made without departing from the scope thereof. The scope of the present disclosure is limited only by the appended claims.

What is claimed is:

1. A method of compensating for pixel data, applied to a display panel, the method comprising:

obtaining a first display area and a second display area of the display panel;

obtaining, by mapping respective initial pixel data of pixels in the first display area using a preset grayscale target value, respective intermediate pixel data of the pixels in the first display area; and obtaining, by compensating for respective initial pixel data of pixels in the second display area and the respective intermediate pixel data of the pixels in the first display area using preset compensation coefficients, respective target pixel data of pixels in the second display area and the first display area.

2. The method according to claim 1, wherein obtaining, by mapping the respective initial pixel data of the pixels in the first display area using the preset grayscale target value, the respective intermediate pixel data of the pixels in the first display area, comprises:

obtaining a grayscale level of pixels in the display panel;

obtaining a ratio of the preset grayscale target value to the grayscale level; and for each of the pixels in the first display area, obtaining a product of the ratio and initial pixel data of the pixel and taking the product as intermediate pixel data of the pixel.

3. The method according to claim 1, wherein obtaining, by compensating for the respective initial pixel data of the pixels in the second display area and the respective intermediate pixel data of the pixels in the first display area using the preset compensation coefficients, the respective target pixel data of the pixels in the second display area and the first display area, comprises:

for each of the pixels in the second display area, obtaining a product of a first coefficient in the compensation coefficients corresponding to the pixel and initial pixel data of the pixel, for each of the pixels in the first display area, obtaining a product of the first coefficient in the compensation coefficients corresponding to the pixel and intermediate pixel data of the pixel; and for each of the pixels in the second display area and the first display area, obtaining a sum of the product corresponding to the pixel and a second coefficient in the compensation coefficients corresponding to the pixel and taking the sum as target pixel data of the pixel.

4. The method according to claim 1, further comprising obtaining the preset grayscale target value, comprising:

obtaining brightness of the first display area and brightness of the second display area in the display panel respectively; wherein the second display area refers to an eye fixation area determined according to fixation points of an eye on the display panel, and the first display area refers to an area in the display panel other than the second display area; and obtaining, by adjusting the brightness of the first display area until a ratio of the brightness of the second display area to the brightness of the first display area satisfies a preset ratio threshold, a maximum grayscale of the pixels in the first display area; wherein the maximum grayscale of the pixels in the first display area is the preset grayscale target value.

5. The method according to claim 4, wherein a value range of the ratio threshold is 97% to 99%.

6. The method according to claim 4, wherein obtaining the brightness of the first display area and the brightness of the second display area comprises:

for each of the first display area and the second display area, obtaining an average value of brightness of all pixels, or obtaining an average value of brightness of several pixels, or obtaining brightness of any pixel.

7. The method according to claim 1, further comprising obtaining the preset compensation coefficients, comprising:

for each of a specified number of preset pixel grayscales, obtaining respective brightness data of pixels in the display panel when displaying the preset pixel grayscale;

obtaining an average value of brightness data of the pixels according to the respective brightness data of the pixels when displaying the preset pixel grayscale and taking the average value as a compensation target value corresponding to the preset pixel grayscale;

obtaining, according to a preset correspondence between grayscales and brightness, respective compensation grayscales of the pixels at the preset pixel grayscale based on the compensation target value; and for each of the pixels, obtaining a fitting curve by fitting the specified number of preset pixel grayscales and corresponding compensation grayscales; wherein first coefficients and second coefficients of the fitting curves constitute the compensation coefficients.

8. A display panel, comprising:

a processor;

a memory storing a computer program executable by the processor;

wherein the processor is configured to execute the computer program in the memory to implement:

obtaining a first display area and a second display area of the display panel;

obtaining, by mapping respective initial pixel data of pixels in the first display area using a preset grayscale target value, respective intermediate pixel data of the pixels in the first display area; and obtaining, by compensating for respective initial pixel data of pixels in the second display area and the respective intermediate pixel data of the pixels in the first display area using preset compensation coefficients, respective target pixel data of pixels in the second display area and the first display area.

9. The display panel according to claim 8, wherein obtaining, by mapping the respective initial pixel data of the pixels in the first display area using the preset grayscale target value, the respective intermediate pixel data of the pixels in the first display area, comprises:

obtaining a grayscale level of pixels in the display panel;

obtaining a ratio of the preset grayscale target value to the grayscale level; and for each of the pixels in the first display area, obtaining a product of the ratio and initial pixel data of the pixel and taking the product as intermediate pixel data of the pixel.

10. The display panel according to claim 8, wherein obtaining, by compensating for the respective initial pixel data of the pixels in the second display area and the respective intermediate pixel data of the pixels in the first display area using the preset compensation coefficients, the respective target pixel data of the pixels in the second display area and the first display area, comprises:

for each of the pixels in the second display area, obtaining a product of a first coefficient in the compensation coefficients corresponding to the pixel and initial pixel data of the pixel, for each of the pixels in the first display area, obtaining a product of the first coefficient in the compensation coefficients corresponding to the pixel and intermediate pixel data of the pixel; and for each of the pixels in the second display area and the first display area, obtaining a sum of the product corresponding to the pixel and a second coefficient in the compensation coefficients corresponding to the pixel and taking the sum as target pixel data of the pixel.

11. The display panel according to claim 8, wherein the processor is configured to execute the computer program in the memory to further implement obtaining the preset grayscale target value, comprising:

obtaining brightness of the first display area and brightness of the second display area in the display panel respectively; wherein the second display area refers to an eye fixation area determined according to fixation points of an eye on the display panel, and the first display area refers to an area in the display panel other than the second display area; and obtaining, by adjusting the brightness of the first display area until a ratio of the brightness of the second display area to the brightness of the first display area satisfies a preset ratio threshold, a maximum grayscale of the pixels in the first display area; wherein the maximum grayscale of the pixels in the first display area is the preset grayscale target value.

12. The display panel according to claim 11, wherein a value range of the ratio threshold is 97% to 99%.

13. The display panel according to claim 11, wherein obtaining the brightness of the first display area and the brightness of the second display area comprises:

for each of the first display area and the second display area, obtaining an average value of brightness of all pixels, or obtaining an average value of brightness of several pixels, or obtaining brightness of any pixel.

14. The display panel according to claim 8, wherein the processor is configured to execute the computer program in the memory to further implement obtaining the preset compensation coefficients, comprising:

for each of a specified number of preset pixel grayscales, obtaining respective brightness data of pixels in the display panel when displaying the preset pixel grayscale;

obtaining an average value of brightness data of the pixels according to the respective brightness data of the pixels when displaying the preset pixel grayscale and taking the average value as a compensation target value corresponding to the preset pixel grayscale;

obtaining, according to a preset correspondence between grayscales and brightness, respective compensation grayscales of the pixels at the preset pixel grayscale based on the compensation target value; and for each of the pixels, obtaining a fitting curve by fitting the specified number of preset pixel grayscales and corresponding compensation grayscales; wherein first coefficients and second coefficients of the fitting curves constitute the compensation coefficients.

15. A non-transitory computer-readable storage medium, wherein an executable computer program in the storage medium is executed by a processor to implement:

obtaining a first display area and a second display area of a display panel;

obtaining, by mapping respective initial pixel data of pixels in the first display area using a preset grayscale target value, respective intermediate pixel data of the pixels in the first display area; and obtaining, by compensating for respective initial pixel data of pixels in the second display area and the respective intermediate pixel data of the pixels in the first display area using preset compensation coefficients, respective target pixel data of pixels in the second display area and the first display area.

16. The storage medium according to claim 15, wherein obtaining, by mapping the respective initial pixel data of the pixels in the first display area using the preset grayscale target value, the respective intermediate pixel data of the pixels in the first display area, comprises:

obtaining a grayscale level of pixels in the display panel;

obtaining a ratio of the preset grayscale target value to the grayscale level; and for each of the pixels in the first display area, obtaining a product of the ratio and initial pixel data of the pixel and taking the product as intermediate pixel data of the pixel.

17. The storage medium according to claim 15, wherein obtaining, by compensating for the respective initial pixel data of the pixels in the second display area and the respective intermediate pixel data of the pixels in the first display area using the preset compensation coefficients, the respective target pixel data of the pixels in the second display area and the first display area, comprises:

for each of the pixels in the second display area, obtaining a product of a first coefficient in the compensation coefficients corresponding to the pixel and initial pixel data of the pixel, for each of the pixels in the first display area, obtaining a product of the first coefficient in the compensation coefficients corresponding to the pixel and intermediate pixel data of the pixel; and for each of the pixels in the second display area and the first display area, obtaining a sum of the product corresponding to the pixel and a second coefficient in the compensation coefficients corresponding to the pixel and taking the sum as target pixel data of the pixel.

18. The storage medium according to claim 15, wherein the executable computer program in the storage medium is executed by the processor to further implement obtaining the preset grayscale target value, comprising:

obtaining brightness of the first display area and brightness of the second display area in the display panel respectively; wherein the second display area refers to an eye fixation area determined according to fixation points of an eye on the display panel, and the first display area refers to an area in the display panel other than the second display area; and obtaining, by adjusting the brightness of the first display area until a ratio of the brightness of the second display area to the brightness of the first display area satisfies a preset ratio threshold, a maximum grayscale of the pixels in the first display area; wherein the maximum grayscale of the pixels in the first display area is the preset grayscale target value.

19. The storage medium according to claim 18, wherein a value range of the ratio threshold is 97% to 99%.

20. The storage medium according to claim 15, wherein the executable computer program in the storage medium is executed by the processor to further implement obtaining the preset compensation coefficients, comprising:

for each of a specified number of preset pixel grayscales, obtaining respective brightness data of pixels in the display panel when displaying the preset pixel grayscale;

obtaining an average value of brightness data of the pixels according to the respective brightness data of the pixels when displaying the preset pixel grayscale and taking the average value as a compensation target value corresponding to the preset pixel grayscale;

obtaining, according to a preset correspondence between grayscales and brightness, respective compensation grayscales of the pixels at the preset pixel grayscale based on the compensation target value; and for each of the pixels, obtaining a fitting curve by fitting the specified number of preset pixel grayscales and corresponding compensation grayscales; wherein first coefficients and second coefficients of the fitting curves constitute the compensation coefficients.

* * * * *